US005930749A

United States Patent [19]

Maes

[11] Patent Number: 5,930,749

[45] Date of Patent: Jul. 27, 1999

[54] MONITORING, IDENTIFICATION, AND SELECTION OF AUDIO SIGNAL POLES WITH CHARACTERISTIC BEHAVIORS, FOR SEPARATION AND SYNTHESIS OF SIGNAL CONTRIBUTIONS

[75] Inventor: Stephane Herman Maes, Danbury, Conn.

[73] Assignee: International Business Machines Corporation, Armonk, N.Y.

[21] Appl. No.: 08/787,037

[22] Filed: Jan. 28, 1997

Related U.S. Application Data

[60] Provisional application No. 60/011,058, Feb. 2, 1996.

[51] Int. Cl.[6] ..... G10L 9/14; G10L 7/02

[52] U.S. Cl. ..... 704/228; 704/219; 704/233; 704/262

[58] Field of Search ..... 704/219, 228, 704/233, 262

[56] References Cited

U.S. PATENT DOCUMENTS

| | | | |
|---|---|---|---|
| 5,298,674 | 3/1994 | Yun | 84/616 |
| 5,375,188 | 12/1994 | Serikawa et al. | 704/215 |
| 5,457,769 | 10/1995 | Valley | 704/210 |

OTHER PUBLICATIONS

John D. Hoyt and Harry Wechsler, "Detection of Human Speech in Structured Noise," Proc. IEEE ICASSP 94, vol. II, pp. 237–240, Apr. 1994.

John D. Hoyt and Harry Wechsler, "RBF Models for Detection of Human Speech in Structured Noise", Proc. IEEE Conf. on Neural Networks, pp. 4493–4496, Jun. 1994.

John D. Hoyt and Harry Wechsler, "Detection of Human Speech using Hybrid Recognition Models," Proc. 12th International Conf. on Pattern Recognition, pp. 330–333, Oct. 1994.

Richard O. Duda and Peter E. Hart, Pattern Classification and Scene Analysis, Wiley–Interscience, p. 24, 1973.

John R. Deller, Jr., John G. Proakis, and John H. L. Hansen, Discrete–Time Processing of Speech Signals, Prentice–Hall, pp. 65 and 878, 1987.

*Primary Examiner*—David R. Hudspeth
*Assistant Examiner*—Tālivaldis Ivars Šmits
*Attorney, Agent, or Firm*—Whitham, Curtis & Whitham; Robert P. Tassinari, Esq.

[57] ABSTRACT

A system for processing a signal representing acoustical information performs a linear predictive coding (LPC) analysis and segments the signal into music, speech and noise components (including channel noise and acoustic artifacts) in accordance with behavior, over time, of the poles describing the signal, resulting from the LPC analysis. Poles exhibiting behavior characteristic of speech, music and channel noise of interest may then be selected while other poles representing random noise or information which is not of interest are suppressed. A "cleaned" signal can then be synthesized, with or without additional pre-processing to further suppress unwanted components of the signal. Additionally or alternatively, tags can be applied to frames or groups of frames of the original signal to control application of decoding procedures or speech recognition algorithms. Alternatively, the synthesized "cleaned" signal may be used as an input to a vector quantizer for training of codebooks and channel assignments for optimal processing of the original signal.

15 Claims, 3 Drawing Sheets

MONITORING, IDENTIFICATION, AND SELECTION OF AUDIO SIGNAL POLES WITH CHARACTERISTIC BEHAVIORS, FOR SEPARATION AND SYNTHESIS OF SIGNAL CONTRIBUTIONS

CROSS-REFERENCE TO RELATED APPLICATIONS

This application is a continuation-in-part of a provisional U.S. patent application Ser. No. 60/011,058, entitled Speaker Identification System, filed Feb. 2, 1996, priority of which is hereby claimed under 35 U.S.C. §119(e)(1) and which is hereby fully incorporated by reference.

DESCRIPTION

BACKGROUND OF THE INVENTION

1. Field of the Invention

The present invention generally relates to systems for processing electrical signals representing acoustic waveforms and, more particularly, to speech and speaker detection and recognition and other processing of signals containing human speech.

2. Description of the Prior Art

Many electronic devices require input from a user in order to convey to the device particular information required to determine or perform a desired function or, in a trivially simple case, when a desired function is to be performed as would be indicated by, for example, activation of an on/off switch. When multiple different inputs are possible, a keyboard comprising an array of two or more switches has been the input device of choice in recent-years.

However, keyboards of any type have inherent disadvantages. Most evidently, keyboards include a plurality of distributed actuable areas, each generally including moving parts subject to wear and damage and which must be sized to be actuated by a portion of the body unless a stylus or other separate mechanical expedient is employed. Accordingly, in many types of devices, such as input panels for security systems and electronic calculators, the size of the device is often determined by the dimensions of the keypad rather than the electronic contents of the housing. Additionally, numerous keystrokes may be required (e.g. to specify an operation, enter a security code, etc.) which slows operation and increases the possibility that erroneous actuation may occur.

Perhaps more importantly, use of a keyboard inherently requires knowledge of particular keystrokes or combinations thereof which are associated with functions or data which must be input. For example, a combination of numbers for actuation of a lock for secured areas of a building or a vehicle requires the authorized user to remember the number sequence as well as correctly actuating corresponding switches in sequence to control initiation of a desired function. Therefore, use of a keyboard or other manually manipulated input structure requires action which is not optimally natural or expeditious for the user. Further, for security systems in particular, the security resides in the limitation of knowledge of a keystroke sequence and not in the security system itself since the security system cannot identify the individual actuating the keys.

In an effort to provide a more naturally usable, convenient and rapid interface and to increase the capabilities thereof, numerous approaches to voice or sound detection and recognition systems have been proposed and implemented with some degree of success. However, many aspects of an acoustically communicated signal have defeated proper operation of such systems. For example, of numerous known speech analysis algorithms, none are uniformly functional for different voices, accents, formant variation and the like and one algorithm may be markedly superior to another for a particular utterance than another (particularly when mixed with other background acoustic signals) for reasons which may not be readily apparent. Nevertheless, some empirical information has been gathered which can generally assign an algorithm to a particular signal which can then be expected to at least perform correctly, if not always optimally, for a particular utterance or segment thereof. Algorithm assignment becomes especially critical now that speech recognition systems are also used to transcribe remote (e.g. telephone) or recorded (e.g. broadcast news) speech signals.

Another aspect of acoustically communicated signals which affects both algorithm choice and successful performance is the fact that few speech signals, as a practical matter, are purely speech. Unless special provisions are made which are often economically prohibitive or incompatible with the required environment of the device (e.g. a work place, an automobile, etc.), background signals will invariably be included in an acoustically communicated signal.

Background may include the following non-exhaustive list of contributions: street noise, background speech, music, studio noise, static noise, mechanical noise, air circulation noise, electrical noise and/or any combination thereof. It can also be distorted by the communication channel (e.g. telephone, microphone, etc.). Signal components respectively attributable to speech and various types of background are not easily separated using previously known techniques and no successful technique of reliably doing so under all conditions is known.

SUMMARY OF THE INVENTION

It is therefore an object of the present invention to provide a system and method for segmentation of a signal representing an acoustic communication according to the categories of speech, noisy speech, noise, pure music and speech plus music.

It is another object of the invention to provide a system and method capable of selective suppression of non-speech or non-music signal components of a signal representing an acoustic communication.

It is a further object of the invention to provide a system and method for speech recognition capable of providing different portions of a signal acquired under different background conditions, with suppressed non-speech components, ready to be processed for recognition with adapted algorithms.

It is yet another object of the invention to provide a primary signal analysis methodology which is successfully applicable to all acoustic signals and which facilitates further processing of resulting segments of the signal.

It is another further object of the invention to provide extraction of the contribution of non-speech effects, classify those effects as a background or channel of the input speech and selecting additional signal processing or adapting or decoding algorithm depending on the result of the classification.

The invention proposes a way to use LPC analysis or, more generally, signal pre-processing of the input waveform to detect the contributions associated with speech, music and non-speech effects. As a result, input waveforms can be automatically segmented and processed with specially adapted algorithms. Also, each of the contributions can be isolated from other contributions. Enhanced speech contributions, obtained by removing music and non-speech effects can be decoded with models trained under similar conditions. Non-speech effects can be classified to detect the channel or background of the input speech.

In order to accomplish these and other objects of the invention, a method is provided for processing a signal representing acoustically transmitted information including the steps of analyzing the signal to derive poles of an expression representing a plurality of samples of the signal during a frame, monitoring behavior of the poles thus derived over a period of time including a plurality of frames, and selecting poles having a characteristic behavior over a plurality of frames.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
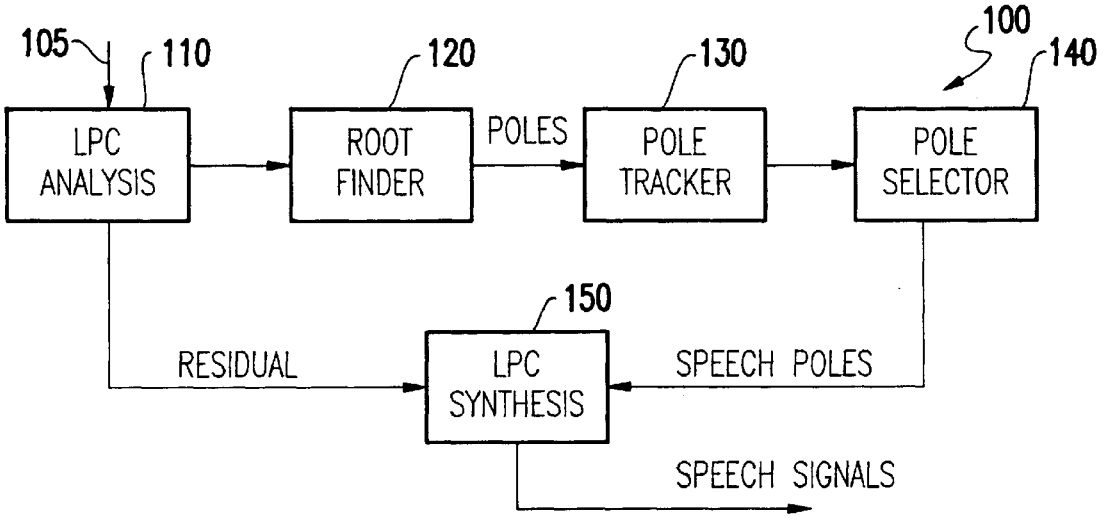
FIG. 1 is a high-level block diagram/flow chart illustrating the basic principles of the invention.

Referring now to the drawings, and more particularly to FIG. 1, there is shown a flow chart illustrating the methodology of the invention. It should be understood that the depiction of the invention in FIG. 1 (and FIGS. 2 and 3, as well) could be considered as being a high-level block diagram of apparatus 100 for carrying out the invention. In this latter regard, it should be further understood that while the invention is preferably carried out utilizing a suitably programmed general purpose digital computer, the functional elements depicted in the drawings are exemplary of functional elements which would be established within the computer by such programming. The figures thus also illustrate a suitable and preferred processor architecture for practicing the invention.

Of course, a special purpose processor configured in the manner depicted would be expected to achieve somewhat enhanced performance levels in comparison with a general purpose processor. Nevertheless, a general purpose processor is preferred in view of the flexibility which may be provided for inclusion of other processing as may be desired and will be explained below with reference to FIGS. 2 and 3. Further, it will be noted that the Figures define several pipelines such as the sequence of elements 110, 120, 130 and 140 and high levels of performance have recently become available from even modest processors suitable for so-called personal computers by adaptation to accommodate concurrent processing in respective stages of each such pipelines.

The process in accordance with the invention begins with subjecting an arbitrary signal 105 to linear predictive coding (LPC) analysis 110 which is well-understood in the art. Incidentally, LPC analysis can be based on either autocorrelation or covariance; autocorrelation being much preferred for practice of the invention. If methods based on covariance are used, the process must be stabilized by pseudo-inversion (e.g. so-called single value decomposition (SVD)). This method of signal analysis is, itself, well-known and numerical methods of carrying out such an analysis on digital processors are similarly known. The result is essentially an expression which represents the behavior of the signal during a frame comprising a plurality of samples of the signal.

This representation is partially a fraction with a complex polynomial denominator which may be factored in the form of (x-a) where x and a can be complex expressions including frequency and phase. Solutions for x in each factor of the denominator which will render the expression infinite (e.g. x=a) are referred to as poles. The representation of the signal provided by the LPC analysis 110 will also include initial condition or "excitation" information which may be regarded as "residual" Thus, processing indicated at element or step 120 is a simple and well-understood manipulation of each factor of the denominator resulting from the LPC analysis. In accordance with the invention, the poles of the LPC analysis are of interest and may be thus extracted.

It should be noted that the number of poles of the representation of the signal resulting from the LPC analysis corresponds to the "order" of the analysis and a high-order LPC analysis is preferred to provide as high a degree of fidelity to the original signal over each frame as possible or practical.

It has been found adequate to the efficient and effective practice of the invention to provide a frame having a few hundred samples with the sampling frequency being at least twice the bandwidth of interest in the signal. Correspondingly, an LPC analysis of order twelve to eighteen is considered to be adequate for effective and efficient practice of the invention for isolation of speech from music and noise and such a number of samples per frame. A higher order analysis should generally be used for good fidelity if music is to be extracted from speech and noise.

The poles thus extracted from the result of the LPC analysis can then be tracked over a number of frames by dynamic programming algorithm (also well-understood in the art). To visualize the process, after plotting the center frequencies and bandwidths of all poles along a vertical axis as a function of the frame index (horizontal axis), the dynamic programming fits the longest and smoothest curve to the center frequency lines, rejecting incompatible poles. As an alternative, in accordance with the preferred embodiment of the invention, the poles are clustered over a plurality of frames to determine the behavior of each pole over increments of time larger than a frame. That is, for a single frame, the poles of the representation resulting from the LPC analysis are necessarily constant since it is the signal behavior over a single, specific frame which is represented. For a plurality of time-adjacent or overlapping frames, the poles may or may not change over time. It has been discovered by the inventors that the variation over time of each of the poles resulting from the LPC analysis 110 correlates well with the basic types of information (e.g. speech, music and various classes of noise) that may be present in combination in the input signal 125.

Specifically, music components of the signal will show very little variation in the value of the poles representing them and are thus very stable. Frequency information in the poles corresponding to poles representing music components of the signal will also be of narrow bandwidth and related as multiples of the twelfth root of two (about 5% difference in frequency corresponding to a semitone of a musical chromatic scale; twelve semitones constituting an octave or doubling of frequency). Poles representing speech signal components exhibit a slow drift over time. Poles representing noise, on the other hand, will vary randomly but may have some characteristics of variation which can further categorize various classes of noise.

Thus, broadly, the information content of a signal subjected to high-order LPC analysis will cause a predictable and detectable behavior of variation in the value of the resulting poles in a representation of the signal and other behaviors of the poles may be regarded as representing noise or channel distortions (e.g. acoustic artifacts such as reverberation and resonances, electrical noise components, etc.). Even some behaviors representing noise may be categorized statistically as particular types of noise if of interest, such as particular types of channel distortions. For example, a channel distortion representing a particular resonance or reverberation may indicate an attempt to defeat a security system by reproduction of a recorded voice. Distinct and detectable behaviors of poles which contain information allows them to be separated for further analysis or processing including assignment of processing algorithms.

It should be further recognized for an appreciation of the invention, therefore, that the stability or slow variation over a set of frames of poles of music and speech components, respectively, are the characteristics used to recognize the behavior of respective poles in a set of frame so that a behavior can be attributed to poles of a single frame. Thus, the pole tracker essentially correlates the poles corresponding to a frame with the most closely related pole of a previous frame to facilitate determination of the behavior of each of the poles over time. An illustration of an elementary form of dynamic programming is depicted in FIG. 1*a*.

In this example, table or register 125 or other form of output stage of root finder 120 will contain the poles for a particular sample. (Twelve pole are shown as being exemplary of a twelfth order LPC analysis.) Comparator and switching element 131 (the form of which is unimportant to the invention but may advantageously be in the form of a decision tree) compares each pole to a pole of the previous frame fed back from the first stage of each of plurality of shift registers 132. While this comparison may be conducted sequentially or in parallel, pole 1 through pole 12 are each compared with each of the poles previously entered into shift register stages 132*a* through 1321 and then each of pole 1 through pole 12 is stored into one of shift register stages 132*a*–1321 based upon best match (e.g. of frequency, phase, etc. or a combination) or another statistically determinable criterion; shifting previously stored poles into subsequent stages of each shift register.

Concurrently for each sample, data in all of the stages of each shift register 132 are compared at comparator element 133, such as by determining the maximum and minimum values of the stored poles in each shift register or channel. The length of the shift register is unimportant to the invention but should be determined in accordance with the nature of the signal to be processed but preferably the shift register length is about ten stages. Limits can be imposed on the amount (e.g. magnitude, rapidity, etc.) of variation of the values of the poles at element 134 which essentially functions as a threshold comparator to categorize each channel as music, speech or type of noise. The result is then used to control pole selector 140 which may simply block rapidly or randomly fluctuating pole values (and/or highly stable pole values) as noise (or music) to isolate the poles representing speech information. Alternatively or in combination therewith, for example, the result of thresholding at limit element 134 could be used to tag or flag each channel in accordance with the type of information or noise component which is thus determined to be represented in the sequence of poles of that channel.

Figure 1A:
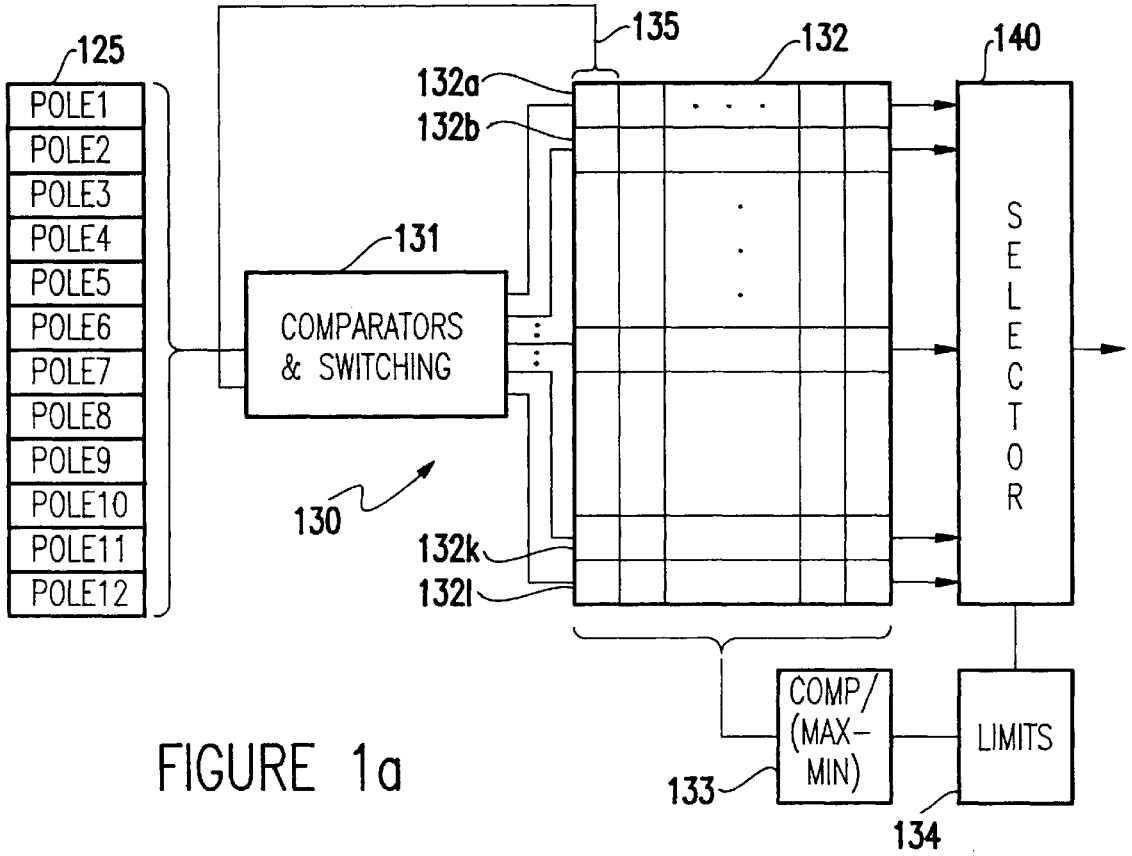
FIG. 1*a* is a more detailed block diagram illustrating a simplified form of a dynamic programming implementation of pole tracking in the system or method of FIG. 1.

It should be understood that the above description of FIG. 1*a* is provided to facilitate visualization of the basic operation of the invention in a possible implementation based on smoothness of evolution of the pole behavior and in which poles are assigned to channels in a dynamic manner. A simpler and preferred methodology for practical implementation extracts poles by a well-understood stabilized Laguerre method or other classical root extraction algorithm. Then, extracted poles are clustered within the unit circle with the number of clusters forced to equal the order of the LPC analysis to determine the correspondence of poles from frame-to-frame. This technique also facilitates the discarding of poles if too far from any cluster as in the case of complex poles which suddenly become real. Selection can now be performed directly, preferably with decision trees.

For example, if some clusters of poles exhibit a slow drift over more than ten frames, have a small bandwidth for their frequency position and/or are distributed in frequency by a multiple of a fundamental frequency (e.g. $2^{1/12}$) they are considered to be associated with music. Low and high frequency poles are also good candidates to be classified as music poles since a large percentage of the information content of speech is generally limited in frequency content to between about 100 Hz to about 8000 Hz while the frequency range of music will often extend well beyond that range.

Faster drift of poles which remains smooth and continuous while having a somewhat wider bandwidth (of each pole) are associated with speech. Thresholds for drift and bandwidth may be set empirically or derived adaptively. The remaining poles are associated with noise or channel distortions. Since thresholds may be applied sequentially to determine music, speech and noise/channel distortions based on thresholds of drift, continuity and/or bandwidth, decision trees are preferred for classification of poles or pole clusters.

Based on this classification, poles representing information of interest may be selected and combined into "cleaned" frames while other frames are eliminated. The signal represented by the "cleaned" frames may then the reconstructed by LPC synthesis 150 by reversing the analysis process and using the known excitation included in the residual signal or otherwise processed as will be described below with reference to FIG. 2.

Specifically, the nature of poles thus determined may be used to extract or tag frames into, for example, three categories of pure music, pure speech (and noise) and speech plus music. Poles that do not contain any of music, speech or channel distortions may be eliminated since the information represented will not generally be useful in tagging of frames. Tagging of frames, as indicated at 210 allows selection of particular processing to be applied to each frame of the original signal at signal processor 220. Pure music frames do not need to be decoded. Frames tagged as pure speech can be decoded with classical speech recognition algorithms. Frames tagged as speech plus music can be preprocessed to reduce the effects of music (e.g. using a comb filter to eliminate specific music frequencies or other techniques such as echo cancellation). Thereafter, these frames can be treated with models trained with cleaned data (i.e. mixing music with cleaned speech, music pole cancellation, inversion of the speech poles or model adaptation based on the cleaned signal using cancellation and inversion as described herein).

Figure 2:
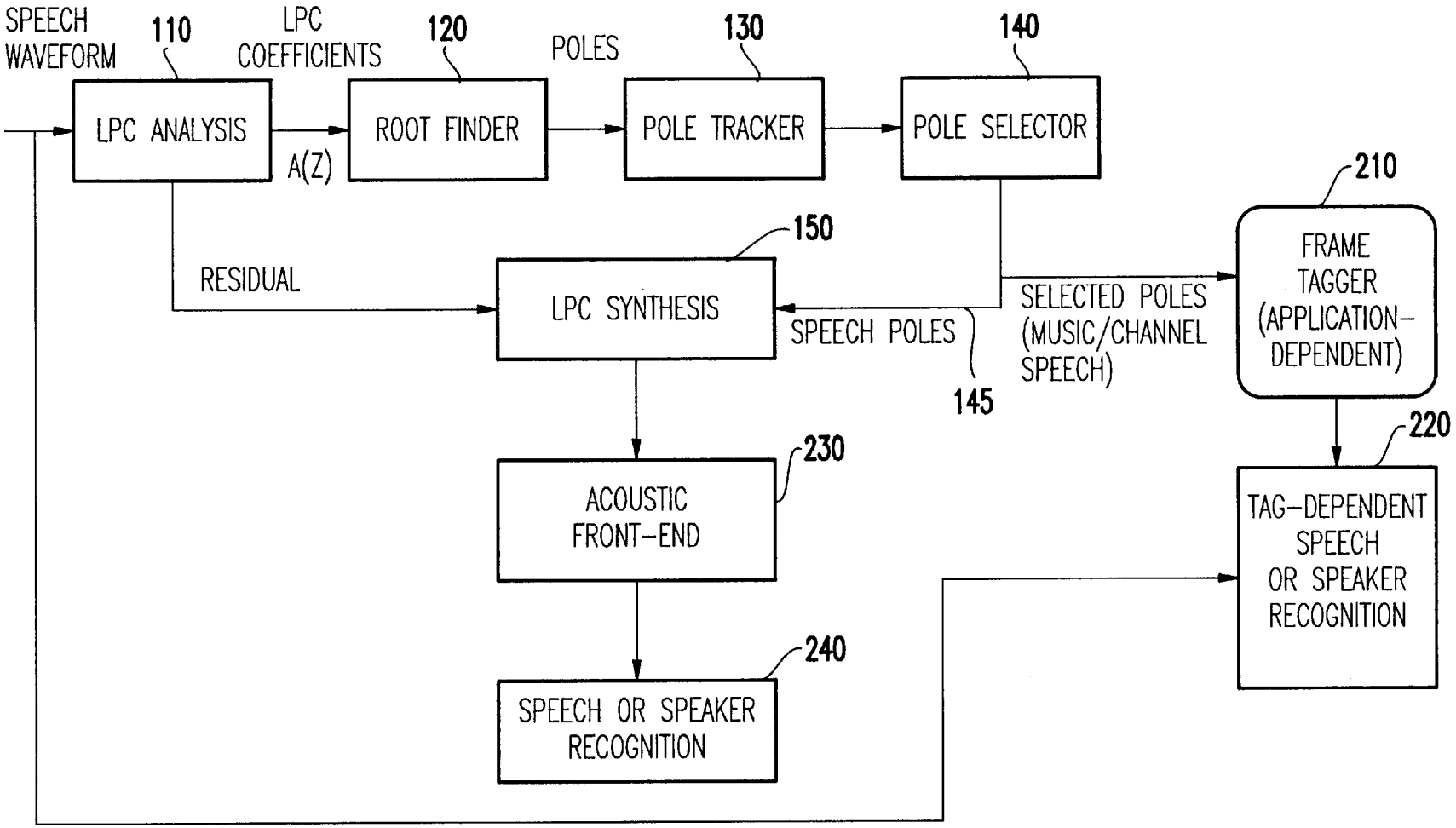
FIG. 2 is a high-level block diagram/flow chart illustrating additional processing for speech recognition and speaker recognition utilizing the principles of the invention.

When no music is present, the poles of pure speech frames (which can contain some noise) may be further cleaned by further pole selection into pure speech poles and channel or noise poles by application of more stringent thresholds as to rate and continuity of pole drift. This selection, indicated at 145 of FIG. 2, is particularly efficient when no music is present and constitutes an alternative methodology in accordance with the invention to systematically enhance distorted speech signals.

Once the signal has been thus segmented (e.g. the poles of interest have been thus selected), the signal component or components of interest (e.g. speech and/or music) can be reconstructed using the known excitation (contained in the residual information output of LPC analysis 110) and the selected poles by inverting the LPC analysis, depicted as LPC synthesis element 150. Thus, to the limit of the resolution of the order selected for the LPC analysis, a music and/or speech signal can be effectively purged of noise by selecting poles based on the signature of their temporal variation. By the same token, presence of certain types of noise may be isolated if of interest on much the same basis as the tag-dependent processing described above except that a "cleaned" signal is synthesized from the selected poles rather than by applying selected processing to each frame of the original signal.

In particular, unexpected background noise types or channel distortions (e.g. reverberations, reproduction artifacts, non-linearities characteristic of digital audio tape devices, etc.) may indicate an attempt to defeat a security system with a recording device. For this purpose, a background classifier may be used, as will be described below. Thus for different classes of background signatures, different decoding models (e.g. adaptive algorithms) can be trained or different algorithms and/or preprocessing front-end processing assigned as indicated at 230. The cleaned signal thus produced or the original signal can then be further processed for speech or speaker recognition by known algorithms but which can be applied with improved efficiency and accuracy in accordance with the invention as will now be described with reference to FIG. 3.

In general, the application of optimum or near-optimum models and algorithms for processing of speech signals, referred to in the art as "channel identification", is extremely important for correct speech or speaker recognition. Having performed LPC analysis, extracted the poles of interest and synthesized a "cleaned" signal as described above, the synthesized signal may be used to select processing for the original signal. Conceptually, the system identifies the channel distortions which exist in the synthesized signal to select optimal pre-processing for the original signal which mitigates the effects of such distortions and/or the classification algorithm can be modified to reduce the mismatch.

For example, channel identification such as a telephone channel or the characteristic distortions of different types of microphones allows the use of models which have been previously developed or adaptively trained under similar conditions. Other selectable processing such as cepstral mean subtraction can reduce non-stationary properties of the network. Likewise, identification of background noise or music can be used to invoke models trained with the same type of noise and/or music and noise cancellation for processing of the original signal.

Figure 3:
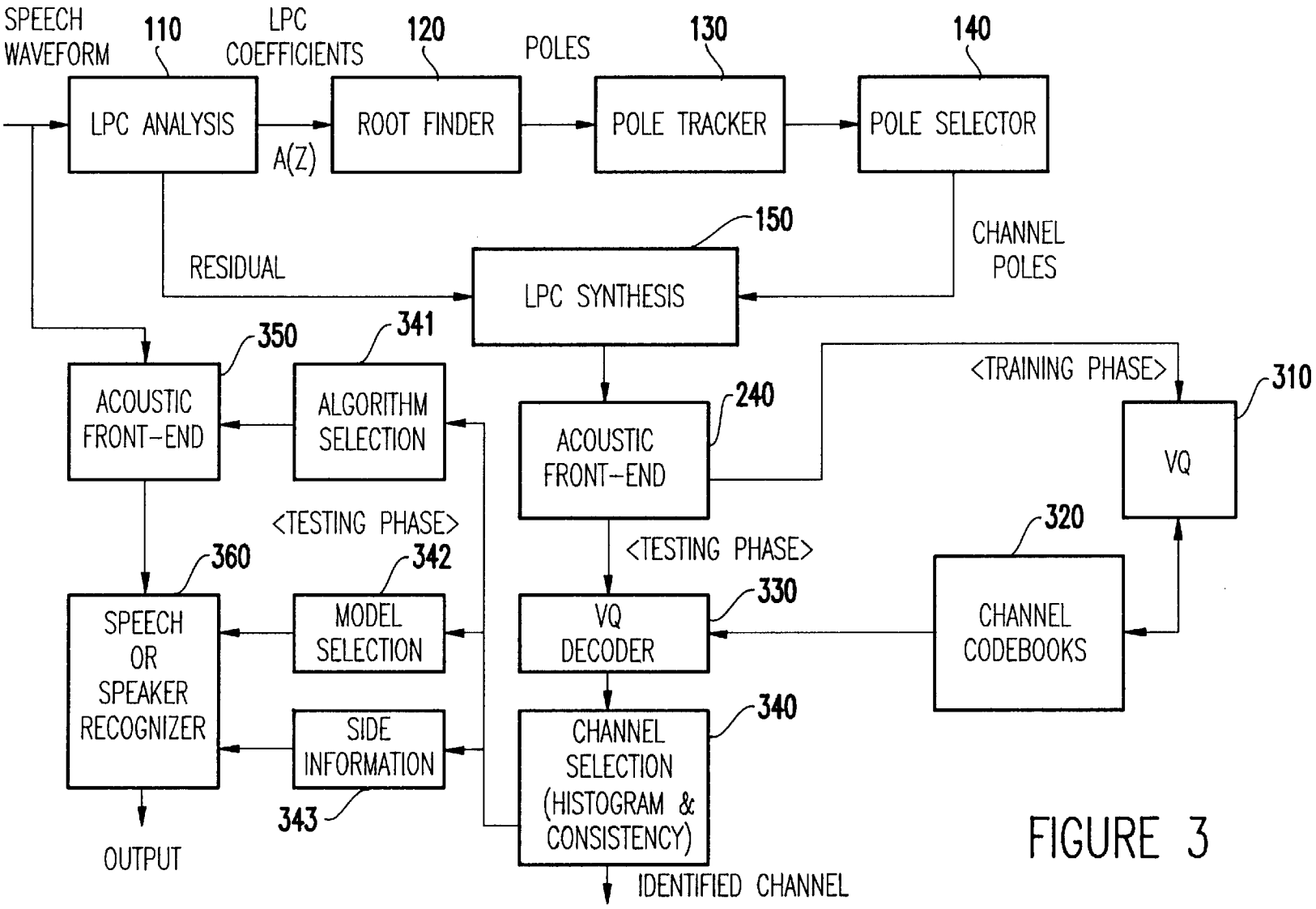
FIG. 3 is a high-level block diagram/flow chart illustrating additional processing for channel and algorithm selection utilizing the principles of the invention.

In the preferred configuration shown in FIG. 3, the acoustic front-end 230 applied on the synthesized signal preferably includes processing to obtain feature vectors known as MEL cepstra (a classical set of parameters obtained by regrouping of the spectrum according to the MEL frequency law, a well-defined frequency scale, based on physiological considerations, taking the logarithm of the rearranged spectrum and inverting the Fourier transform of the result), delta and delta-delta (including CO(energy)) which are numerical first and second derivatives with respect to time of the MEL cepstra. All of these sets of parameters may be regarded as thirty-nine dimension vectors.

Such processing is, itself, well-known and the nature of the vectors is familiar to those skilled in the art and will correspond to particular channel identifiers. Other feature vectors such as LPC cepstra could also be used in conjunction with a LPC cepstra channel identifier. However, the efficiency of the channel identification and hence the speech recognizer, for which model prefetching is implemented, depends on the set of features used. These feature vectors are preferably computed on overlapping 30 millisecond frames with frame-to-frame shifts of 10 milliseconds. (It should be noted that since this processing is performed on a synthesized signal, the duration and overlap of frames is independent of the definition of frames used for LPC analysis.)

The channel identification system preferably comprises a vector quantizer (VQ) 310 and stores a minimum of information about each enrolled channel (e.g. each model available and corresponding to a selectable processing channel which, in the preferred embodiment of the invention is a codebook 320 containing about sixty-five codewords (the number is not critical), their variances and optional scores provided for matching with the output of the vector quantizer). When the features associated to a block of frames (at least one second) has been matched to a codebook representative of a channel (or background), the associated channel is identified and the system can load the associated channel-dependent model for speech recognition.

This function may be done adaptively by clustering feature vectors of a synthesized signal belonging to a given channel. The resulting centroids constitute the codewords associated to that channel and the variances are also stored. Eventually, some additional scores are developed and stored indicating how many features of a quantized vector are associated with a particular codeword while being far apart from it along a Mahalanobis distance (a Euclidean distance with weights that are the inverse of the variance of each dimension of the feature vector) or a probabilistic distance which is the log-likelihood of the Gaussian distribution of feature vectors associated with the codeword and having the same mean and variances. Such training is typically accomplished in about two to ten seconds of signal but training data can be accumulated continuously to improve the codebooks 320.

Identification of the channel is done by the VQ decoder 330 which, on a frame-by-frame basis identifies the closest codebook (or ranks the N closest codebooks) to each feature vector. The identified codebooks for respective frames are accumulated to develop a histogram indicating how many feature vectors have identified a particular codebook. The codebook selected most often thus identifies a potentially appropriate channel for processing of the original signal. A consistency check is preferably performed to determine a confidence level for the channel selection at channel selection element 340. Two approaches to channel identification are possible. Either all the types of channels have been enrolled initially and the identification selects the closest match for channel identity or the consistency check determines when a segment is too dissimilar from currently enrolled models. In the former case the speech or speaker recognition system can load models adapted for the channel and use it for decoding and/or unsupervised adaptation of the model. In the latter case, a new model is built on the new segment and new recognition models can be adapted on the channel in much the same way.

The consistency checks are preferably based on several different tests. First, a clear maximum appearing in the histogram discussed above indicates a relatively high confidence level that the corresponding channel selection would be correct. In such a case, further testing based on variances may be eliminated. However, if two or more channels are competing, testing based on variances are more critical to correct channel identification or assignment and should be carried out. In testing based on variances, for each feature vector, the distance to each of the candidate competing codewords is compared to the associated variances of each codeword to develop a score (e.g. the distance normalized by the variance) for each combination of feature vector and candidate codeword. These scores may be accumulated with other information in the codebook, if desired, as an incident of training, as described above.

If the relative distances are frequently too large relative to the associated scores for a particular candidate codebook, the corresponding codebook is rejected and if no codebook can be thus accepted, no channel is identified. However, in practice, candidate channels will begin to appear after about three seconds of speech signal and channel selection is generally completed within about ten seconds of speech signal. Accordingly, optimal channel assignment with specification of optimal processing and signal model can be accomplished very quickly in accordance with the invention.

Specifically, as a channel identification is made, a signal processing algorithm 341 can be applied to acoustic font-end 350 for initial processing of the original input signal to suppress undesired components. Alternatively or in combination therewith, a model selection 342 can be applied to a speech or speaker recognition processor 360. In this way, an optimal model can be applied to the signal based on the closest match of the cleaned signal to an adaptively trained and tested codebook, yielding high levels of speech and/or speaker recognition performance in short processing time and limiting recognition failure and ambiguity to very low levels.

It should also be recognized that the channel selection 340 can be used as side information 343, itself. For example, the channel selection may fully identify a speaker or be usable in speaker identification. Similarly, channel selection based on signal artifacts or content can be used to verify or directly determine if the utterance was spoken directly into a particular type of microphone or reproduced from, for example, a recording device or a different type of microphone which could be used in an attempt to defeat security applications of the invention. In the latter case, of course, the speaker would be rejected even if recognized.

In view of the foregoing, it is seen that the signal processing arrangement in accordance with the invention provides for analysis of a signal allowing separation of components of a signal in accordance with recognized speech, music and/or noise content and the synthesis of a cleaned signal eliminating a substantial portion of speech, music and/or noise, depending on the signal content of interest. The invention also allows use of a cleaned signal for channel assignment in order to apply appropriate decoding and/or optimal processing to respective segments of an input signal in a tag-dependent manner or adaptively with a short learning and decision time. Thus the invention is applicable to all signals representing acoustical content and facilitates optimal processing thereof.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A method for processing a signal representing acoustically transmitted information, said method including the steps of analyzing said signal to derive poles of an expression representing a plurality of samples of said signal during a frame, monitoring behavior of said poles over a period of time including at least two frames, and selecting poles having a characteristic behavior as determined by said monitoring step from among poles derived by said analyzing step.

2. A method as recited in claim 1, including the further step of synthesizing a signal from said poles selected during said selecting step.

3. A method as recited in claim 2, wherein said synthesizing step is performed by inversion of said analyzing step.

4. A method as recited in claim 2, including the further steps of developing a quantized vector codebook containing feature vectors for signals obtained under similar conditions from the signal resulting from said synthesizing step by said selection of poles, identifying a channel in accordance with selection of a codebook optimally representing said feature vectors, and applying an algorithm to said signal in accordance with said selection of poles.

5. A method as recited in claim 4, wherein said step of selection of poles includes the further step of applying a tag value to a frame.

6. A method as recited in claim 4, including the further steps of recognizing a portion of said signal, and suppressing output of results of said recognizing step in accordance with said step of identifying a channel.

7. A method as recited in claim 1, wherein said selecting step includes detecting poles having a frequency which is a multiple of a fundamental frequency.

8. A method as recited in claim 1, wherein said selecting step includes detecting poles having a frequency which is substantially stationary over at least ten frames.

9. A method as recited in claim 8, including the further step of suppressing poles detected by said detecting step.

10. A method as recited in claim 1, wherein said selecting step includes detecting poles having a frequency which is below about 100 Hz or above 8000 Hz.

11. A method as recited in claim 10, including the further step of suppressing poles detected by said detecting step.

12. A method as recited in claim 1, wherein said selecting step includes detecting poles which vary slowly in a continuous fashion.

13. A method as recited in claim 12, including the further step of suppressing poles detected by said detecting step.

14. A method as recited in claim 1, wherein said selecting step includes detecting poles which vary randomly in a discontinuous fashion.

15. A method as recited in claim 1, including the further steps of applying a tag identifying frame content to frames of said signal in accordance with results of said selection step, and processing respective frames of said signal in accordance with said tags.

* * * * *